US006181087B1

(12) United States Patent
Hamaguchi et al.

(10) Patent No.: US 6,181,087 B1
(45) Date of Patent: Jan. 30, 2001

(54) DISCHARGE LAMP OPERATING DEVICE

(75) Inventors: Takahisa Hamaguchi, Tokyo; Osamu Ishikawa, Kanagawa, both of (JP)

(73) Assignees: Mitsubishi Denki Kabushiki Kaisha, Tokyo; Mitsubishi Electric Lighting Corporation, Kamakura, both of (JP)

( * ) Notice: Under 35 U.S.C. 154(b), the term of this patent shall be extended for 0 days.

(21) Appl. No.: 09/485,386

(22) PCT Filed: Jul. 30, 1998

(86) PCT No.: PCT/JP98/03401

§ 371 Date: Feb. 9, 2000

§ 102(e) Date: Feb. 9, 2000

(87) PCT Pub. No.: WO00/07413

PCT Pub. Date: Oct. 2, 2000

(51) Int. Cl.[7] ..... H05B 37/02; H05B 41/14
(52) U.S. Cl. ..... 315/308; 315/307; 315/225
(58) Field of Search ..... 315/307, 308, 315/224, 225, 219, 312, 324, 247, DIG. 5

(56) References Cited

U.S. PATENT DOCUMENTS

| | | | | |
|---|---|---|---|---|
| 4,356,433 | * | 10/1982 | Linden | 315/308 |
| 5,485,061 | * | 1/1996 | Ukita et al. | 315/307 |
| 5,747,947 | * | 5/1998 | Hak | 315/308 |
| 5,930,126 | * | 7/1999 | Griffin et al. | 315/225 |
| 6,002,214 | * | 12/1999 | Ribarich | 315/307 |
| 6,008,592 | * | 12/1999 | Ribarich | 315/225 |

FOREIGN PATENT DOCUMENTS

| | | |
|---|---|---|
| 1-265498 | 10/1989 | (JP) . |
| 3-205789 | 9/1991 | (JP) . |
| 3-205790 | 9/1991 | (JP) . |
| 5-89984 | 4/1993 | (JP) . |
| 5-242982 | 9/1993 | (JP) . |

* cited by examiner

*Primary Examiner*—Don Wong
*Assistant Examiner*—Wilson Lee
(74) *Attorney, Agent, or Firm*—Burns, Doane, Swecker & Mathis, LLP

(57) ABSTRACT

A discharge lamp lighting apparatus according to this invention comprises: an inverting circuit for converting a DC input into a high frequency output; a load circuit which is connected to the inverting circuit and is constructed by a plurality of discharge lamps; a detecting resistor connected between a terminal of the inverting circuit and a ground; an integrating circuit for integrating a voltage generated in the detecting resistor; an operational amplifier which receives an output of the integrating circuit as a negative input, receives a predetermined target value as a positive input, and performs an error amplification; a driver for controlling a switching frequency of the inverting circuit on the basis of an output of the operational amplifier; a frequency detecting comparator which inputs the output of the operational amplifier and whose output value is switched in the case where a frequency converted at an input value exceeds a predetermined value; a control circuit for switching an operating state of the driver depending on the output value of the frequency detecting comparator; and a latch circuit for holding the operating state switched by the control circuit in the case where the converted frequency exceeds the predetermined value. Therefore, even if a plurality of lamps are mounted, the circuit can be protected from a life ending lamp without performing a life ending detection for each lamp. The burden of the inverting circuit can certainly be detected and a protection can be performed, since the life states of a plurality of the lamps are detected in total.

2 Claims, 4 Drawing Sheets

DISCHARGE LAMP OPERATING DEVICE

TECHNICAL FIELD

This invention relates to a discharge lamp lighting apparatus in which a lamp life ending detection is performed on a feedback loop with respect to a discharge lamp lighting apparatus of a method such that a consuming electric power of a discharge lamp (hereinbelow, abbreviated to a "lamp") is fed back and the lamp is lit.

BACKGROUND ART

A conventional discharge lamp lighting apparatus will be described with reference to drawings. FIG. 3 is a diagram showing a construction of a discharge lamp lighting apparatus of a lamp electric power feedback method which has conventionally been known.

In FIG. 3, reference numeral 1 denotes a DC source; 2 an inverting circuit having switching elements such as MOSFETs; 3 a driver; 4 a load circuit; 5*a* to 5*c* lamps; 6 a coupling capacitor; 7*a* to 7*c* ballast coils; and 8*a* to 8*c* starting capacitors.

In FIG. 3, reference numeral 9 denotes a load current detecting resistor; 10 an integrating circuit; 11 an operational amplifier; 11*a* a target value; further, 13 a control circuit; 14 a latch circuit; 19*a* to 19*c* lamp voltage detecting circuit; 20 an overvoltage detecting comparator; and 20*a* a threshold value.

The operation of the conventional discharge lamp lighting apparatus will be mentioned hereinafter.

The inverting circuit 2 is driven by the driver 3 and the DC source 1 is converted to a high frequency output. The high frequency output from the inverting circuit 2 lights the lamps 5*a* to 5*c* through the coupling capacitor 6 and ballast coils 7*a* to 7*c*.

An active component (effective value) of the load current of the load circuit 4 is detected by integrating a voltage generated in the detecting resistor 9 by the integrating circuit 10 and set as a negative input of the operational amplifier 11. The operational amplifier 11 sets the target value 11*a* as a positive input. An error-amplified output is outputted to the driver 3. By the feedback of the operational amplifier 11, the driver 3 controls a switching frequency of the inverting circuit 2 so as to hold the effective value of the load current of the load circuit 4 constant.

Thus, the consuming electric power of the lamp is held constant. Specifically speaking, as shown in FIG. 4, a feedback is performed so that an active component of drain currents of the switching elements constructing the inverting circuit 2 is constant and the frequency is controlled.

Since a lamp voltage increases and the feedback is performed in the direction where the lamp current is suppressed if the life of the lamp is shortened, the frequency beams high and the drain current waveform comes into what as shown in FIG. 5.

In this case, the active component of the drain current is held constant due to the increase in frequency. However, a reactive current also increases simultaneously.

In the case where the life state of the lamp is further shortened and it becomes the life ending, if the frequency is high, the reactive current component further increases. When the reactive current exceeds a certain degree, the switching elements are heated, so that it causes a trouble.

Protecting means for the life ending lamp will be mentioned hereinbelow. The lamp voltage of the life ending lamp is higher than that of the normal lamp. As shown in FIG. 3, the lamp voltage is detected by lamp voltage detecting circuits 19*a*, 19*b*, and 19*c*. The outputs of those detecting circuits are inputted to the comparator 20. In the case where the detection value exceeds a predetermined threshold value 20*a*, the driver 3 is controlled by the operation of the control circuit 13 so that the inverting circuit 2 is protected. Such means has been known.

As for a protecting method, there are a method of stopping an oscillation of the driver 3, a method of forcedly increasing an oscillation frequency of the driver 3 and decreasing both of an active component and a reactive component of the drain current (hereinafter, referred to as a "protection mode operation") and the like. It is latched by the latch circuit 14.

The operation of the lamp voltage detecting circuits 19*a* (similarly with regard to 19*b* and 19*c*) is performed in such a manner that the lamp voltage is divided by capacitors 21 and 22, rectified by diodes 23 and 24, and integrated by a resistor 25 and capacitor 26, thereby obtaining a detection value.

As a result, if one lamp or more in the life ending state exist among the three lamps, the inverting circuit 2 is protected by the operation of the control circuit 13.

However, in the foregoing conventional discharge lamp lighting apparatus, the lamp life ending detection has to be executed every lamp. Particularly, with regard to the apparatus having many lamps, it is a problem that the number of parts increases and costs increase.

In the case where a plurality of (for instance, three) lamps which are not detected in the life ending detection but the life state is slightly shortened (hereinbelow, referred to as a "half-life ending lamp") are connected, a feedback is performed so that lamp currents are set to be constant in total. Consequently, the frequency is made high similar to the case where (for example, one) life ending lamp is mounted, and the burden of the inverting circuit is increased by the increase in the reactive current of the drain current, which causes another problem that the voltage that indicates life ending is not detected in any of the lamp voltage detecting circuit 19*a* to 19*c* to continue an ordinary operation despite of the operation state that is properly meant to be protected.

This invention is accomplished to solve the above mentioned problems. It is an object of the invention to provide a discharge lamp lighting apparatus in which the circuit can be protected from a life ending lamp without executing a life ending detection for each of lamps even if a plurality of lamps are mounted and the burden of the inverting circuit can certainly be detected and protected by detecting in total the states of lives of the plurality of lamps.

It is an object to provide a discharge lamp lighting apparatus in which in the case where the lamp is in the life ending state or the like, the protection mode operation can be performed with a simple construction.

DISCLOSURE OF INVENTION

A discharge lamp lighting apparatus according to this invention comprises: an inverting circuit for converting a DC input into a high frequency output; a load circuit which is connected to the inverting circuit and is constructed by a plurality of discharge lamps; a detecting resistor connected between a terminal of the inverting circuit and a ground; an integrating circuit for integrating a voltage generated in the detecting resistor; an operational amplifier which receives an output of the integrating circuit as a negative input, receives a predetermined target value as a positive input and performs an error amplification; a driver for controlling a switching frequency of the inverting circuit on the basis of an output of the operational amplifier; a frequency detecting comparator which inputs the output of the operational amplifier and whose output value is switched in the case where a frequency converted at an input value exceeds a predetermined value; a control circuit for switching an operating state of the driver depending on the output value of the frequency detecting comparator; and a latch circuit for holding the operating state switched by the control circuit in the case where the converted frequency exceeds the predetermined value.

In a discharge lamp lighting apparatus according to this invention, the control circuit has: an integrating circuit for a timer connected to an output terminal of the frequency detecting comparator; and a lighting sequence circuit connected between an output terminal of the integrating circuit for the timer and the driver, and when the output of the frequency detecting comparator is set to the low level, an output potential of the integrating circuit for the timer drops and the lighting sequence circuit enters an initial state and the low level is latched by the latch circuit.

BEST MODE FOR CARRYING OUT THE INVENTION

Hereinbelow, each of the embodiments of this invention will be described with reference to the drawings.

First Embodiment

Figure 1:
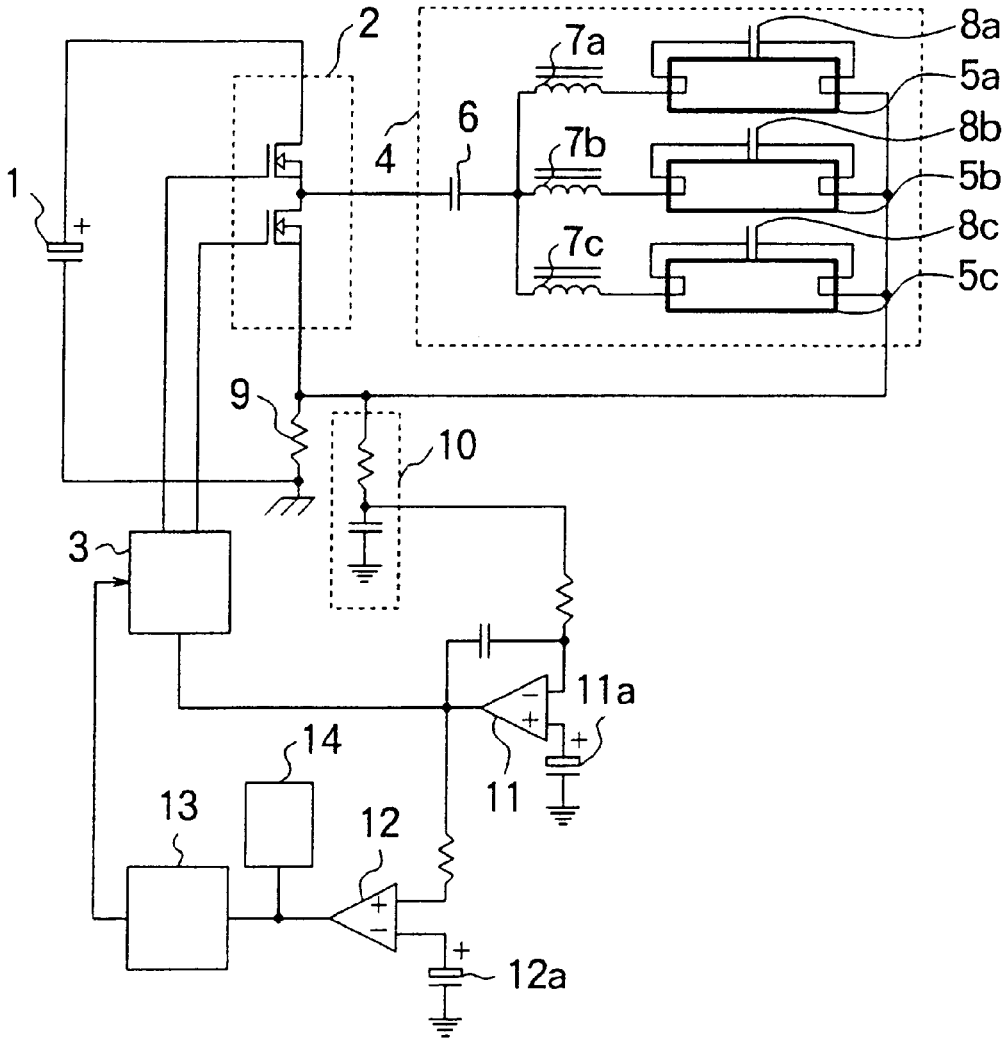
FIG. 1 is a diagram showing a construction of a discharge lamp lighting apparatus according to a first embodiment of this invention.

A discharge lamp lighting apparatus according to a first embodiment of this invention will be described with reference to a drawing. FIG. 1 is a diagram showing a construction of a discharge lamp lighting apparatus according to the first embodiment of this invention. In each of the diagram, the same reference numeral indicates the same or the corresponding portion.

In FIG. 1, reference numeral 1 denotes a DC source; 2 an inverting circuit having switching elements such as MOSFETs; 3 a driver; 4 a load circuit; 5*a* to 5*c* lamps; 6 a coupling capacitor; 7*a* to 7*c* ballast coils; and 8*a* to 8*c* starting capacitors.

In FIG. 1, reference numeral 9 denotes a load current detecting resistor; 10 an integrating circuit; 11 an operational amplifier; 11*a* a target value; further, 12 a comparator for a frequency detection; 12*a* a threshold value; 13 a control circuit; and 14 a latch circuit.

Next, the operation of the discharge lamp lighting apparatus according to the first embodiment will be described with reference to the drawing.

An output of the operational amplifier 11 is inputted to the driver 3. At the same time, the output is inputted to the comparator 12 and an output of the comparator 12 is inputted to the control circuit 13. It is assumed that the driver 3 has negative characteristics for the output voltage of the operational amplifier 11. That is, as for the driver 3, a drive frequency is low if the output potential of the operational amplifier 11 increases, and the drive frequency is high if the output potential drops. Thus, the apparatus is controlled so as to hold the active component of the voltage waveform of the detecting resistor 9 constant. Similarly with the conventional operation, the active component of the drain currents of the switching elements constructing the inverting circuit 2 is held constant.

In case where the life ending lamp is mounted, the output potential of the operational amplifier 11 is lower than the case of the normal lamp and the frequency thereof is higher than the case of the normal one. At this time, when the output potential of the operational amplifier 11 is lower than a predetermined threshold value 12*a* of the comparator 12, that is, the frequency is higher than a predetermined threshold value, the output of the comparator 12 is set to the low level and the control circuit 13 operates in response to the low level output and the protection mode operation is performed or the oscillation is stopped with regard to the driver 3.

Not limited to the case in which a lamp obviously reaching the life ending is mounted, also in the case where a plurality of half-life ending lamps are mounted as well, when the drive frequency of the driver 3 exceeds the predetermined value by the feedback of the operational amplifier 11, the protection mode operation is performed or the oscillation is stopped.

Second Embodiment

Figure 2:
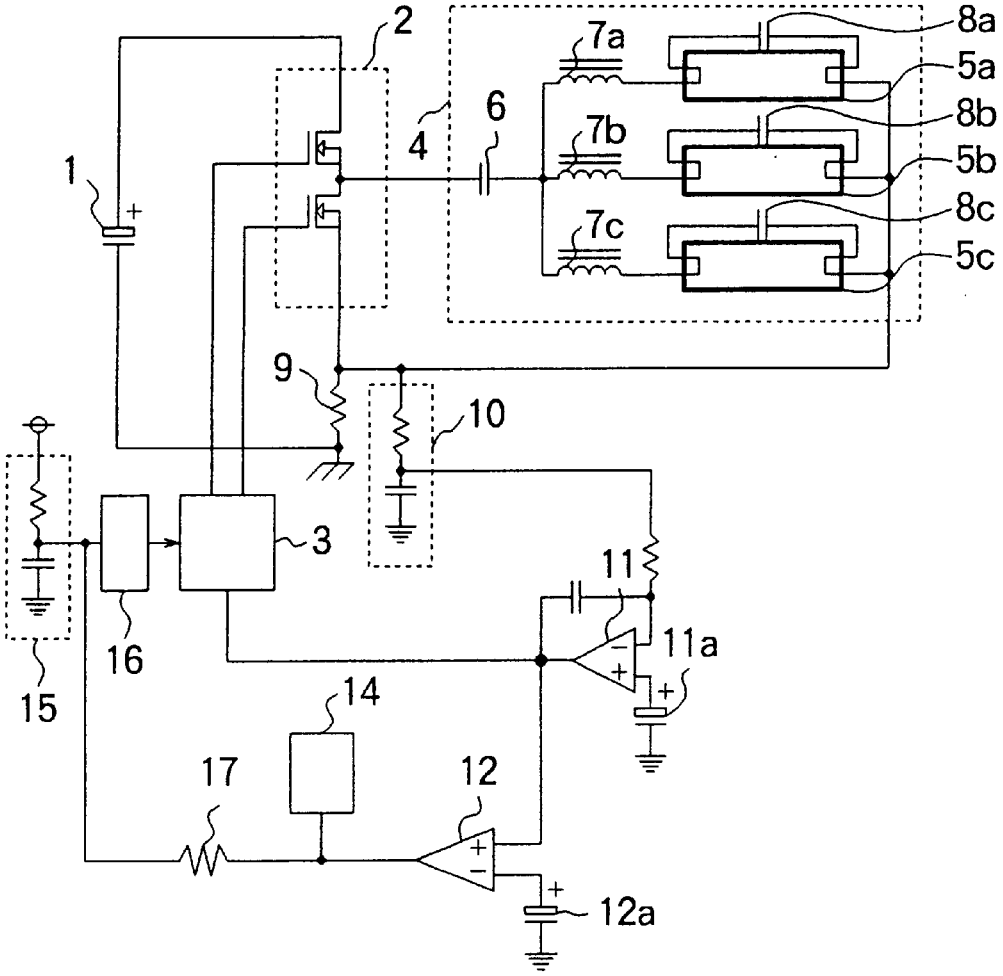
FIG. 2 is a diagram showing a construction of a discharge lamp lighting apparatus according to a second embodiment of this invention.
Figure 3:
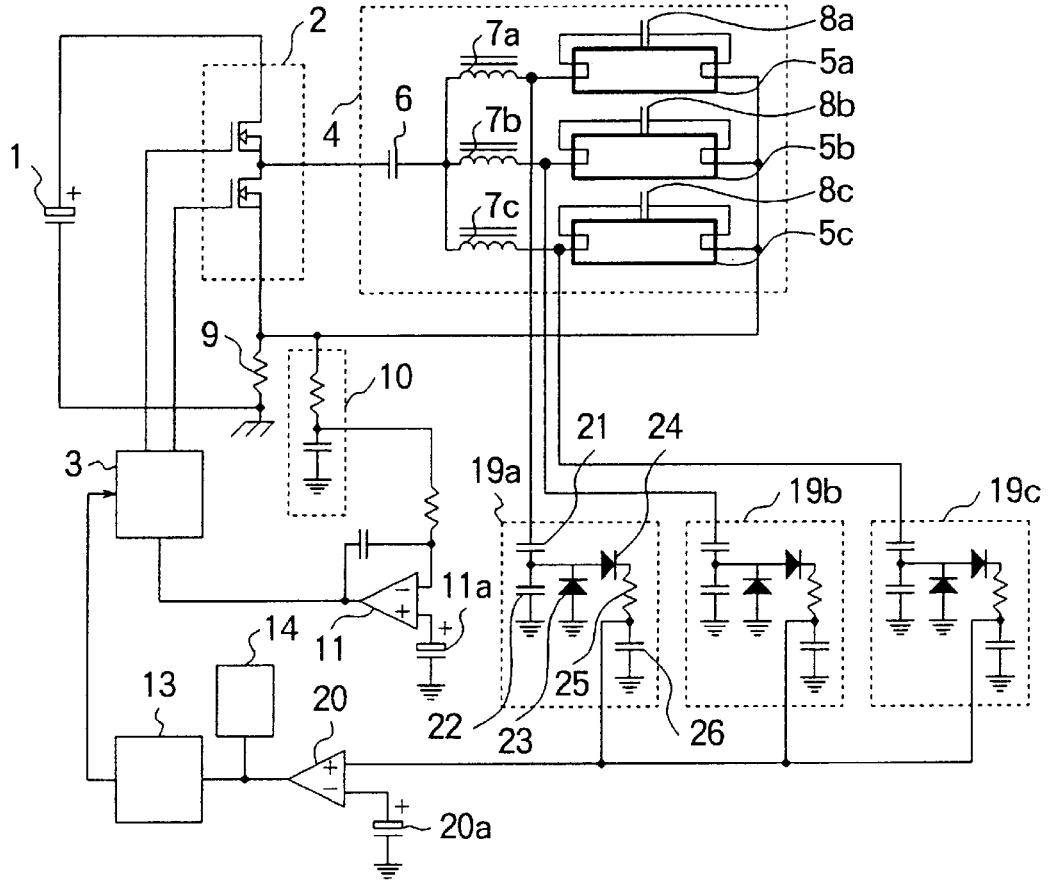
FIG. 3 is a diagram showing a construction of a conventional discharge lamp lighting apparatus.
Figure 4:
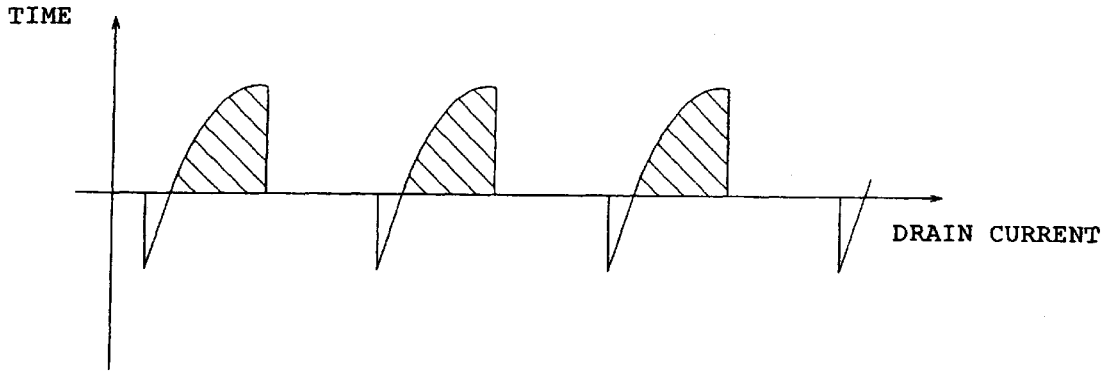
FIG. 4 is a diagram showing a drain current waveform of a switching element of the conventional discharge lamp lighting apparatus.
Figure 5:
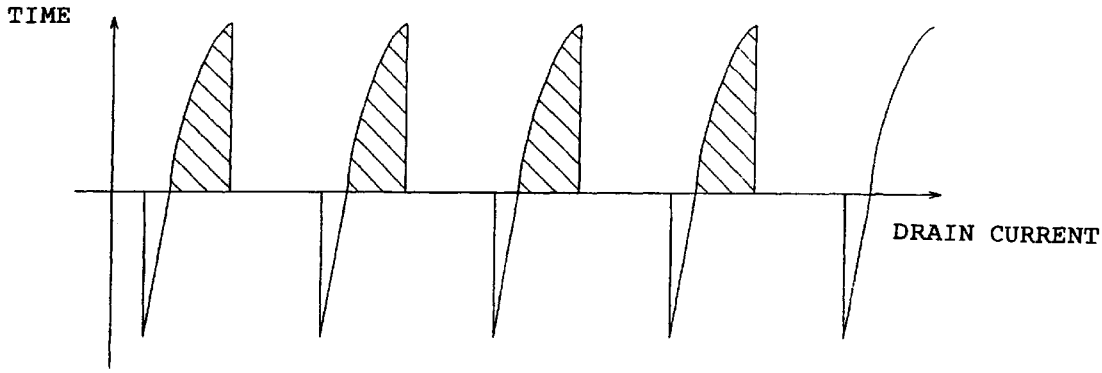
FIG. 5 is a diagram showing a drain current waveform of a switching element of the conventional discharge lamp lighting apparatus.

A discharge lamp lighting apparatus according to a second embodiment of the invention will now be described with reference to the drawing. FIG. 2 is a diagram showing a construction of a discharge lamp lighting apparatus of a second embodiment of the invention.

In FIG. 2, reference numeral 15 denotes an integrating circuit for a timer; and 16 a lighting sequence circuit. An output of a comparator 12 is connected to the output of the integrating circuit 15 for the timer through a resistor 17. Another construction is same as that of the above first embodiment.

The operation in the case where the lamp is normal is similar to that of the first embodiment. In the case where the lamp in life ending state is mounted, the operation such that the output of the comparator 12 is set to the low level is also similar to that of the first embodiment.

Usually, in the initial state at the time of turning on the power source, the output of the comparator 12 is set to the high level. In the lighting sequence circuit 16, the integrating circuit 15 for the timer is charged, so that the oscillation frequency is decreased from the initial state (for example, preheating frequency) to the lighting frequency. When the output of the comparator 12 is set to the low level, the output potential of the integrating circuit 15 for the timer drops and the lighting sequence circuit 16 is returned to the initial state. With this, the drive frequency of the driver 3 is forcedly increased and the protection mode operation is performed.

In the case of increasing the drive frequency forcedly, the output of the operational amplifier 11 is fixed to the upper limit value and is higher than the threshold value 12*a*. However, the output of the comparator 12 is held to the low level by the latch circuit 14 and it is constructed such that the protection state is held.

In the embodiment, the apparatus for three lamps has been described. However, the present invention may sufficiently be applied to an apparatus for two lamps or less or an apparatus for four lamps or more.

Moreover, in the embodiment, the driver 3 has the negative characteristics for the output of the operational amplifier 11. However, it can be also easily applied to the driver having the positive characteristics by adding an inversion amplifying circuit or the like.

Industrial Applicability

As described above, a discharge lamp lighting apparatus according to this invention comprises: an inverting circuit for converting a DC input into a high frequency output; a load circuit which is connected to the inverting circuit and is constructed by a plurality of discharge lamps; a detecting resistor connected between a terminal of the inverting circuit and a ground; an integrating circuit for integrating a voltage generated in the detecting resistor; an operational amplifier which receives an output of the integrating circuit as a negative input, receives a predetermined target value as a positive input and performs an error amplification; a driver for controlling a switching frequency of the inverting circuit on the basis of an output of the operational amplifier; a frequency detecting comparator which inputs the output of the operational amplifier and whose output value is switched in the case where a frequency converted at an input value exceeds a predetermined value; a control circuit for switching an operating state of the driver depending on the output value of the frequency detecting comparator; and a latch circuit for holding the operating state switched by the control circuit in the case where the converted frequency exceeds the predetermined value. Therefore, the circuit can be protected from a life ending lamp without executing the life ending detection for each lamp even if a plurality of lamps are mounted. Such effect can be obtained that the burden of the inverting circuit can certainly be detected and a protection can be performed, since the life states of a plurality of the lamps are detected in total.

As described above, in a discharge lamp lighting apparatus according to this invention, the control circuit has: an integrating circuit for a timer connected to an output terminal of the frequency detecting comparator; and a lighting sequence circuit connected between an output terminal of the integrating circuit for the timer and the driver, and when the output of the frequency detecting comparator is set to the low level, an output potential of the integrating circuit for the timer drops, the lighting sequence circuit enters an initial state and the low level is latched by the latch circuit. Therefore, in the case where the lamp is in the life ending state or the like, an effect that a protection mode operation can be performed with a simple construction can be obtained.

What is claimed is:

1. A discharge lamp lighting apparatus comprising:

an inverting circuit for converting a DC input into a high frequency output;

a load circuit which is connected to said inverting circuit and is constructed by a plurality of discharge lamps;

a detecting resistor connected between a terminal of said inverting circuit and a ground;

an integrating circuit for integrating a voltage generated in said detecting resistor;

an operational amplifier which receives an output of said integrating circuit as a negative input, receives a predetermined target value as a positive input, and performs an error amplification;

a driver for controlling a switching frequency of said inverting circuit on the basis of an output of said operational amplifier;

a frequency detecting comparator which inputs the output of said operational amplifier and whose output value is switched in the case where a frequency converted at an input value exceeds a predetermined value;

a control circuit for switching an operating state of said driver depending on the output value of said frequency detecting comparator; and a latch circuit for holding the operating state switched by said control circuit in the case where said converted frequency exceeds the predetermined value.

2. A discharge lamp lighting apparatus according to claim 1, wherein said control circuit has:

an integrating circuit for a timer connected to an output terminal of said frequency detecting comparator; and a lighting sequence circuit connected between an output terminal of said integrating circuit for the timer and said driver, and when the output of said frequency detecting comparator is set to the low level, an output potential of said integrating circuit for the timer drops, said lighting sequence circuit enters an initial state, and said low level is latched by said latch circuit.

* * * * *